United States Patent [19]

Petrusek

[11] 4,121,829

[45] Oct. 24, 1978

[54] KICK BALL GAME

[76] Inventor: Victor Petrusek, 18511 Gottschalk St., Homewood, Ill. 60430

[21] Appl. No.: 786,106

[22] Filed: Apr. 11, 1977

[51] Int. Cl.[2] ..... A63B 67/10; A63B 69/26

[52] U.S. Cl. ..... 273/95 A; 272/78; 273/58 C

[58] Field of Search ..... 273/95 R, 95 A, 97 R, 273/98, 58 C, DIG. 17, DIG. 19; 35/19 A; 2/49 R, 52; 272/76, 77, 78; 24/132 R, 137 A, 115 H, DIG. 22, 251; 339/28, 29 R, 29 B, 255 P, 261

[56] References Cited

U.S. PATENT DOCUMENTS

| | | | |
|---|---|---|---|
| 667,563 | 2/1901 | Oakley | 273/58 C X |
| 811,546 | 2/1906 | Conroy | 272/77 |
| 1,753,310 | 4/1930 | Costello | 272/78 |
| 1,941,877 | 1/1934 | Brazeau | 272/77 |
| 1,945,440 | 1/1934 | Maslo | 272/78 |
| 2,186,016 | 1/1940 | Evans | 272/78 |
| 2,477,653 | 8/1949 | Roane | 35/19 A |
| 2,571,888 | 10/1951 | Jesse | 2/49 R |
| 3,137,027 | 6/1964 | Birkle | 24/251 |
| 3,351,343 | 11/1967 | Papp | 273/98 X |
| 3,398,955 | 8/1968 | Rakestraw | 273/98 |
| 3,589,726 | 6/1971 | Crowder | 273/98 |
| 4,021,035 | 5/1977 | O'Hara | 272/78 |
| 4,042,241 | 8/1977 | Collins | 273/95 A |

FOREIGN PATENT DOCUMENTS

| | | | |
|---|---|---|---|
| 728,643 | 4/1932 | France | 272/78 |
| 2,105,389 | 4/1972 | France | 273/95 A |
| 838,470 | 6/1960 | United Kingdom | 273/95 A |

*Primary Examiner*—William H. Grieb

*Attorney, Agent, or Firm*—Tilton, Fallon, Lungmus & Chestnut

[57] ABSTRACT

A kick ball game comprising an inflatable ball formed of elastomeric material connected to a tether which is looped around a player's neck. The tether includes a connecting segment anchored to the ball, a highly stretchable elastic segment joined to the connecting segment, and an elongated substantially non-stretchable cord secured to the elastic segment. At its free end, the cord is equipped with a spring clamp capable of releasable attachment to the cord itself to form a closed loop to be fitted about the neck of a player. By adjusting the position of the clamp along the portion of the cord received by the jaws of the clamp, the player may eliminate slack in the tether and thereby suspend the ball in front of his foot or, less desirably, his knee or lower leg. Thereafter, the ball may be kicked, swinging outwardly away from the player's foot and then back towards his foot where it may be kicked again, the process being repeated by the player in an attempt to establish a record number of successive kicks. A self-releasing clamp construction, and a stop for limiting the minimum size of the loop of cord about the wearer's neck, are also disclosed.

10 Claims, 5 Drawing Figures

FIG. 3
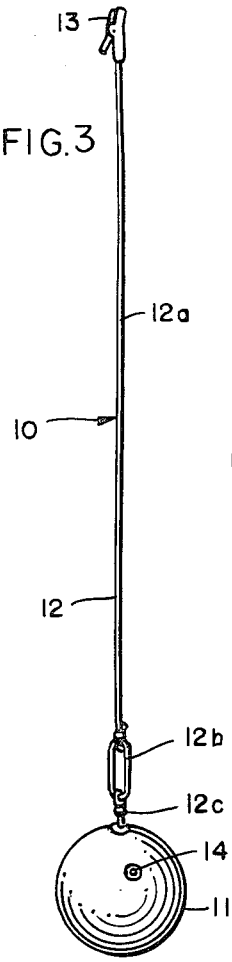
FIG. 1
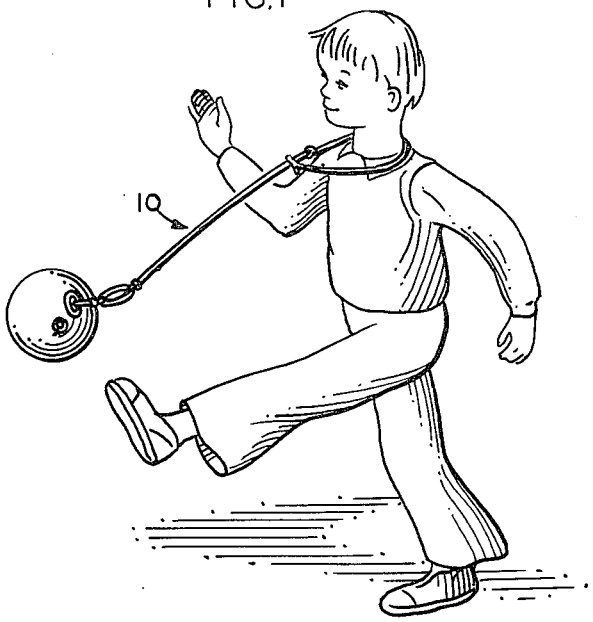
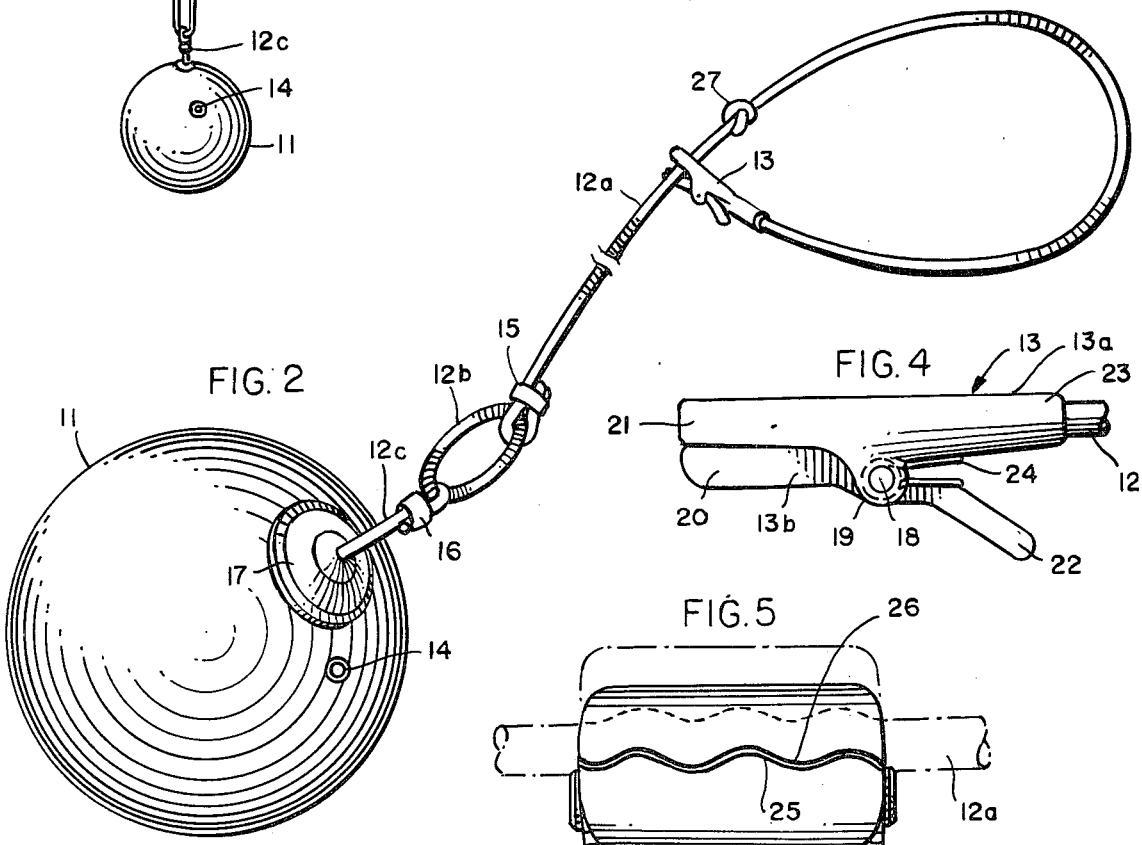
FIG. 2
FIG. 4
FIG. 5
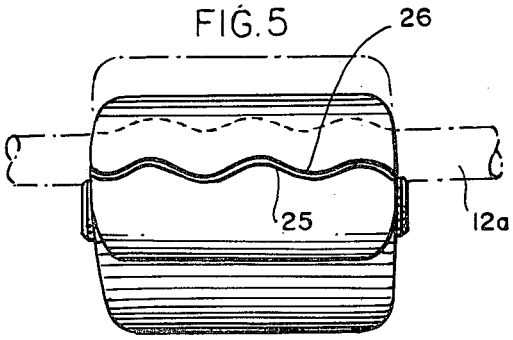

KICK BALL GAME

BACKGROUND AND SUMMARY

While games involving tethered balls have been known in the past, the tethering has ordinarily been undertaken for the purpose of securing the balls to some inanimate objects to prevent their escape during practice or play. See U.S. Pat. Nos. 3,589,726, 3,398,955, and 3,351,343. In some instances the cords have been non-stretchable in their entirety, while in other cases they have been formed of elastic material but, in any event, the primary purpose of the cords or tethers has been to limit travel of the balls so that they may be easily retrieved and repositioned for further practice strokes with suitable clubs, rackets, bats, or the like. In addition, baseballs or other practice balls have been joined by elastic straps to the wrists of users so that the balls after being thrown are returned by the straps towards the users' hands to improve coordination and catching skills. See U.S. Pat. No. 667,563. Other types of devices have been known as, for example, paddles to which balls have been connected by elastic bands, and basket-like receptacles to which balls or other objects have been connected by cords; in most such devices, the elastic cords have performed the function of redirecting the balls towards the impact surfaces or receiving elements.

The present invention is concerned with an amusement device which similarly involves a ball which is equipped with a tether. Unlike prior devices, however, the tether is formed of sections having different physical characteristics with the principal length of the tether being formed of a substantially non-stretchable cord and a relatively short section of the cord near the ball being formed of highly elastic material. The cord is equipped at its free end with a clamp, the clamp being attachable to the cord at any point along its intermediate section to form a loop intended to be extended about the neck of the user. By adjusting the size of the loop the length of the tether may be varied so that the ball is suspended from the player's neck, such ball being disposed at substantially the same elevation as the player's feet or, in some cases, his knees. Kicking of the ball causes it to swing outwardly and forwardly in pendulum fashion with the pivot point of the pendulum being at the player's neck. The short elastic band, interposed along the length of the tether adjacent the ball, serves as a shock absorber without producing any appreciable recoil action that might interfere with proper pendulum movement of the ball. Impact shock is also reduced by utilizing a lightweight ball, preferably one which is inflatable.

Although the tether extends about the player's neck, danger is avoided because of the self-releasing nature of the clamp, should a force of considerable magnitude be exerted upon the cord or ball, and because the clamp resists sliding movement along the length of the cord. Hence, there is virtually no possibility of sliding movement of the clamp that might cause a tightening of the cord about the player's neck when the device is properly used. In one form of the invention, stop means, preferably in the form of a knot, is provided to serve as a positive limit against any sliding movement of the clamp which might, under some circumstances which would not be expected to arise during proper use of the toy, result in longitudinal movement of the jaws of the clamp along the length of the cord.

Other structural features, advantages, and objects of the invention will become apparent from the specification and drawings.

DRAWINGS

FIG. 1 is a perspective view of a child using the amusement device of this invention.

FIG. 2 is a fragmentary and enlarged perspective view of the device.

FIG. 3 is a side elevational view of the device with the tether fully extended.

FIG. 4 is an enlarged side elevational view of the clamping device which forms a part of the toy.

FIG. 5 is a still further enlarged front elevational view of the clamp.

DESCRIPTION

Referring to the drawings, the numeral 10 generally designates a kick ball amusement device comprising an inflatable ball 11, a tether 12, and a clamp 13. The tether is composed of three sections: a main section **12*a* which is formed of an essentially non-stretchable cord and which constitutes at least 75 percent of the length of the tether, an elastic segment 12*b*, and a connecting segment 12*c* which is securely joined to the ball 11**.

While the ball 11 may be constructed in various ways, it should be light in weight (generally less than 12 ounces, and preferably less than 8 ounces), be highly resilient and durable, and have a diameter within the general range of 8 to 14 inches. A diameter of 9 to 10 inches is believed particularly effective. Ideally, the ball should e formed of thin elastomeric material and be inflated with air or other suitable gas. A conventional filling tube 14, which also serves as a valve, may be used for inflating the ball and sealing it following such inflation. Since such filling tubes and valves are entirely conventional, being commonly used with beach balls and inflatable toys of various sorts, a more detailed description is believed unnecessary herein. The ball itself may be formed of a spherical sheet of polyvinylchloride or any other suitable elastomeric material.

Cord **12*a* may be formed of natural or synthetic materials and may be of braided, twisted, or monofilament construction. Braided nylon has been found particularly effective because of its flexibility, durability, and substantial non-stretchability; however, other materials having similar properties might also be employed. The length of the cord 12*a*** may vary considerably depending on the size of the child for which the device is intended; however, the length of the cord would ordinarily fall within the general range of 30 to 60 inches.

The elastic segment **12*b* should be highly stretchable and quickly recoverable. Natural or synthetic rubber having a recoverable stretch capability of at least 300 percent should be used for best results. In the embodiment illustrated, the elastic segment takes the form of a rubber band connected at its upper and lower ends to the cord 12*a* and connecting segment 12*c*, respectively. As shown most clearly in FIG. 2, both the cord and the connecting element may be hooked about opposite sides of the elastic band or loop 12*b*, with their ends joined by suitable ferrules or securing elements 15 and 16. While the length of the elastic segment or band 12*b*** may vary, particularly effective results have been achieved where the elastic segment has a length within the range of 2 to 4 inches.

The connecting segment **12*c*** is non-stretchable and may, if desired, be formed of the same material as cord 12*a*. As shown, the connecting segment is secured to the ball by a suitable reinforcing and sealing element 17. The reinforcing and sealing element may take the form of a circular piece of elastomeric material cemented, solvent bonded, or heat sealed to the surface of the ball. The proximal end of segment **12*c* passes through a central opening in the reinforcing patch or sheet 17** and is provided with an enlarged end (not shown) which is sandwiched between the ball and the patch to securely join the tether to the ball.

Clamp 13 comprises a pair of elements **13*a* and 13*b* connected together by pivot pin 18 which spans a pair of apertured ears 19 of element 13*a*. The elements are provided with opposing jaw portions 20 and 21 disposed on one side of pivot 18 and a pair of handle portions 22 and 23 on the opposite side of the pivot. One of the handles 23 is securely connected to cord 12*a*. The jaws are normally held in the closed position illustrated in FIGS. 4 and 5 by suitable spring means, such as leaf spring 24, and may be urged apart by simply squeezing handle portions 22 and 23 towards each other. As shown most clearly in FIG. 5, the opposing jaws preferably have intermeshing undulations or teeth 25 and 26 which extend lengthwise relative to the jaws — that is, in a direction away from and perpendicular to pivot 18. Therefore, when the spring-loaded jaws are allowed to close on an intermediate section of the cord 12*a*, as shown in FIG. 2, the teeth or ribs of the jaws firmly resist forces which might tend to urge the jaws one way or the other along the length of the cord. The reason for such resistance is believed apparent from FIG. 5 where, in broken lines, it is shown that the cord 12*a* conforms to the undulations of the ribs and therefore resists any longitudinal sliding movement between the springbiased jaws. On the other hand, since the ribs or teeth extend only in directions away from the pivot 18, they do not tend to increase resistance to release of the clamp should forces be exerted which extend in the direction of such ribs. The gripping action of the clamp in resisting a force tending to pull it from the cord, in a direction parallel with ribs 25 and 26, depends primarily on the clamping force exerted by spring 24. That clamping force should be great enough to hold the clamp in place for resisting the forces which normally occur when the ball 11 is kicked, but not strong enough to prevent automatic release of the clamp should an excessive force be applied to the ball or tether. Thus, should a playmate tug at the ball with a force greater than the kicking force normally applied when the device is used in ordinary play, clamp 13** will automatically release.

If desired, stop means in the form of an enlargement or knot 27 may be formed in the cord **12*a* at a selected distance, normally 15 to 20 inches, from the clamp end of the cord. The stop serves as a locator to help a child locate the proper position of the clamp which, as shown in FIG. 2, is always between the enlargement 27 and that end of the cord connected to elastic element 12*b***. The enlargement also provides a positive limit against any possible tightening movement of the clamp along the length of cord extending between its jaws as, for example, should another child grip a tether as the device is being worn and attempt to forceably displace the clamp along the length of the cord to cause a tightening of the loop.

In use, a child simply loops the cord **12*a* about his neck, sliding the cord longitudinally until ball 11 just barely touches the ground, or is slightly above the ground, while the tether is taut and the child is standing erect. Clamp 13 is secured in place to maintain the cord in its adjusted condition, the jaws of the clamp being allowed to grip the intermediate portion of the cord at a suitable point, depending on the size and height of the child. The ball, so suspended by the tether from the child's neck, may then be kicked in a manner to cause the ball to swing outwardly and forwardly in a pendulum-like movement (FIG. 1). Upon initial impact, the elastic segment or band 12*b*** stretches slightly to cushion the force transmitted to the player's neck; however, such stretching is relatively slight since, as already described, the principal length of the tether is formed of non-elastic cord.

It is believed apparent that the kick ball device is significant not only for its amusement value, but also because it may contribute significantly in developing the coordination, agility, and timing of a player. The ball may be kept in continuous pendulum movement by a skillful player while he is standing, running, or running-in-place. The extent of such proficiency is indicated not only by the number of times that the ball may be kicked in succession, but also by the other activities (running, etc.) while the player is able to perform at the same time.

While in the foregoing I have disclosed an embodiment of the invention in considerable detail for purposes of illustration, it will be understood by those skilled in the art that many of these details may be varied without departing from the spirit and scope of the invention.

I claim:

1. A kick ball amusement device for children, comprising a lightweight highly resilient ball and a tether securely anchored at one end to said ball, said ball being inflatable and being formed of thin elastomeric material, said tether including a substantially nonstretchable cord constituting a major portion of the length thereof and a stretchable elastic segment interposed between said cord and said ball, and clamping means provided by said cord at the free end thereof for releasably clamping a selected intermediate portion of said cord to form a neckreceiving loop, said clamping means comprising a pair of pivotally-connected jaws and a spring urging said jaws into closed condition for releasably clamping said intermediate portion of said stretchable cord, said jaws being self-releasing upon exertion of a force of predetermined magnitude exerted upon said cord.

2. The device of claim 1 in which said tether also includes a substantially non-stretchable connecting segment interposing between said elastic segment and said ball.

3. The device of claim 1 in which said cord constitutes at least 75 percent of the length of said tether.

4. The device of claim 1 in which said clamp also includes a pair of handle portions, one of said handle portions being fixed to said cord.

5. The device of claim 1 in which said jaws have opposing surfaces provided with ribs extending normal to the axis of pivotal movement of said jaws for restraining longitudinal slipping movement of a portion of said cord gripped between said jaws.

6. The device of claim 5 in which said ribs of said jaws are oriented for intermeshing engagement.

7. The device of claim 1 in which said cord is provided with stop means spaced from said clamp and disposed within said loop when said clamp engages said intermediate portion to establish the minimum circumference of said loop.

8. The device of claim 7 in which said stop means comprises an enlargement formed in said cord.

9. The device of claim 7 in which said stop means comprises a knot formed in said cord.

10. A game-playing method involving a lightweight inflated ball having a tether connected thereto, said tether having an opposite end equipped with a spring clamp, comprising the steps of looping said tether about the neck of a player standing substantially erect on a horizontal playing surface so that said ball is disposed in front of said player, sliding said clamp longitudinally to eliminate slack in that portion of said tether between said neck and said ball, attaching said clamp to that portion of said tether free of slack to releasably secure said ball in suspended condition from said player's neck, said ball being suspended above the ground at the approximate level of the player's feet, and thereafter repeatedly kicking said ball to cause the same to swing on said tether away from and back towards the player's feet.

* * * * *